US009528231B2

(12) United States Patent
Hughes, Jr.

(10) Patent No.: US 9,528,231 B2
(45) Date of Patent: Dec. 27, 2016

(54) TRAFFIC CONTROL MARKER INCLUDING A REINFORCED RETAINING MEMBER

(71) Applicant: Robert K. Hughes, Jr., Fort Meyers, FL (US)

(72) Inventor: Robert K. Hughes, Jr., Fort Meyers, FL (US)

( * ) Notice: Subject to any disclaimer, the term of this patent is extended or adjusted under 35 U.S.C. 154(b) by 0 days.

(21) Appl. No.: 14/547,697

(22) Filed: Nov. 19, 2014

(65) Prior Publication Data

US 2016/0138229 A1 May 19, 2016

(51) Int. Cl.
*E01F 9/08* (2006.01)
*E01F 9/06* (2006.01)
*E01F 9/011* (2006.01)

(52) U.S. Cl.
CPC ..... *E01F 9/06* (2013.01); *E01F 9/011* (2013.01); *E01F 9/0111* (2013.01); *E01F 9/0114* (2013.01); *E01F 9/629* (2016.02); *E01F 9/681* (2016.02)

(58) Field of Classification Search
CPC ..... E01F 9/012; E01F 9/0124; E01F 9/017; E01F 9/06; Y10T 403/11; Y10T 403/7088; Y10T 403/7075; Y10T 403/7077
USPC ..... 404/10, 13; 116/63 R
See application file for complete search history.

(56) References Cited

U.S. PATENT DOCUMENTS 1,205,280 A * 11/1916 Sommer, Sr. ..... A62B 5/00 403/379.5
3,212,415 A * 10/1965 Byrd ..... E01F 9/0175 404/10
3,419,843 A * 12/1968 Hays ..... H01R 4/30 403/388
4,018,054 A * 4/1977 Standley ..... E21D 11/22 403/2
4,522,530 A 6/1985 Arthur
4,645,168 A * 2/1987 Beard ..... E01F 9/012 248/523
5,197,819 A * 3/1993 Hughes ..... E01F 9/0116 116/63 R
5,452,965 A * 9/1995 Hughes, Sr. ..... E01F 9/0111 404/10
5,703,577 A 12/1997 Carter
6,571,884 B1 * 6/2003 Horvath ..... A01B 35/225 172/730
6,719,484 B1 * 4/2004 Johnson ..... E01F 9/0115 116/63 P (Continued)

OTHER PUBLICATIONS

TradersCity webpage: http://www.traderscity.com/board/products-1/offers-to-sell-and-export-1/step-flange-272604/ Aug. 2, 2011.*

(Continued)

*Primary Examiner* — Thomas B Will
*Assistant Examiner* — Katherine Chu
(74) *Attorney, Agent, or Firm* — Bracewell LLP; Brad Y. Chin

(57) ABSTRACT

Embodiments of the invention are directed to a traffic control assembly, which includes a base selectively mountable adjacent a roadway, a flexible tubular member coupled to the base, a reinforced retaining member, and a retaining pin. In accordance with at least one embodiment, the reinforced retaining member, when positioned in a recess in the base, is configured to secure the flexible tubular member to the base.

13 Claims, 13 Drawing Sheets

(56) References Cited

U.S. PATENT DOCUMENTS

| | | | | |
|---|---|---|---|---|
| 6,926,461 | B1 * | 8/2005 | Faller | E01F 15/083 404/10 |
| 7,473,051 | B2 * | 1/2009 | Audet | E01F 9/011 116/63 R |
| 7,849,617 | B2 * | 12/2010 | Intagliata | E01F 9/0175 248/160 |
| 8,348,545 | B1 * | 1/2013 | Hughes, Jr. | E01F 9/087 40/608 |
| 2013/0174776 | A1 | 7/2013 | Hughes, Jr. | |

OTHER PUBLICATIONS

PCT/US2014/066521 International Search Report and Written Opinion dated Jul. 9, 2015; 9pgs.

* cited by examiner

TRAFFIC CONTROL MARKER INCLUDING A REINFORCED RETAINING MEMBER

BACKGROUND

Field of the Invention

Embodiments of the invention generally relate to a traffic control device or marker (hereinafter collectively referred to as a "traffic control marker"). More particularly, various embodiments of the invention are directed to a traffic control marker including a reinforced retaining member.

Description of the Related Art

Traffic control markers used on roadways or other marking areas are frequently struck by moving vehicles. These traffic control markers typically have an outer or primary tube mounted to a base. Typically, the traffic control marker includes a reflective sheeting partially or completely surrounding the primary tube to warn or guide an operator of the moving vehicle, for example, at night or through a construction zone. Examples of commonly used traffic control markers include traffic cones and barrels, as non-limiting examples.

One type of traffic control marker is a flexible delineator highway marker. The highway marker typically includes a flexible insert positioned in a primary tube of the highway marker to provide it with a rebound effect. In particular, the insertion of the flexible insert into the primary tube of the highway marker allows the traffic control marker to return to a substantially upright position after being struck and deflected by a moving vehicle.

Such a traffic control marker, however, features many parts and requires multiple steps to properly assemble and install the flexible insert into the primary tube, which is subsequently attached to the base of the traffic control marker. Additionally, each of the parts included in such a device is naturally subject to wear over time, requiring the disassembly of multiple parts to repair the damaged traffic control marker.

Thus, it would be desirable to provide a traffic control marker, or flexible delineator highway marker, with an improved retaining member to enhance the structural integrity of the outer or primary tube to prevent it from detaching from the traffic control marker on impact by a moving vehicle, to improve the functioning life of the traffic control marker, and to maintain the performance of known types of flexible highway markers, when vehicles deflect them on the roadway or other marking area.

SUMMARY

Embodiments of the invention are directed to a traffic control assembly, which includes a base selectively mountable adjacent a roadway, a flexible tubular member coupled to the base, a reinforced retaining member, and a retaining pin. In accordance with at least one embodiment, the reinforced retaining member, when positioned in a recess in the base, is configured to secure the flexible tubular member to the base.

In accordance with at least one embodiment, each of the base, the flexible tubular member, and the reinforced retaining member includes at least one aperture configured to receive the retaining pin therethrough.

In accordance with at least one embodiment, the flexible tubular member comprises at least one tab configured to reinforce and support the retaining pin, when the retaining pin is inserted through the at least one aperture in the flexible tubular member.

In accordance with at least one embodiment, the at least one tab includes a horizontal seating portion extending perpendicular from a side of the flexible tubular member and a vertical portion configured to attach the horizontal seating portion to the side of the flexible tubular member.

In accordance with at least one embodiment, the flexible tubular member includes at least one tab, the reinforced retaining member includes at least one protrusion and at least one cut-out portion, and the base includes at least one groove, wherein the at least one tab of the flexible tubular member is configured to engage the at least one cut-out portion of the reinforced retaining member and the at least one protrusion of the reinforced retaining member is configured to engage the at least one groove in the base, when the reinforced retaining member is slid down around the flexible tubular member to engage a lower flange of the flexible tubular member in the recess of the base and the retaining pin is inserted through apertures in the base, the flexible tubular member, and the reinforced retaining member.

In accordance with at least one embodiment, the at least one tab includes a curved groove configured to receive the retaining pin for reinforcing the retaining pin during impact of the traffic control assembly by a moving object.

In accordance with at least one embodiment, the flexible tubular member includes a lower flange, the lower flange comprising an upper step and a lower step.

In accordance with at least one embodiment, the lower step of the lower flange includes at least one tab configured to engage a groove in the base of the reinforced retaining member for detachably clipping the flexible tubular member in alignment with the reinforced retaining member.

In accordance with at least one embodiment, flexible tubular member includes a first aperture having a circular shape on a front side of the flexible tubular member and a second aperture having an elongated shape in the vertical direction on a back side of the flexible tubular member.

In accordance with at least one embodiment, the traffic control assembly further includes a flexible core arranged inside the flexible tubular member and configured to be secured in the base.

In accordance with at least one embodiment, the flexible core further includes at least one aperture configured to receive the retaining pin there through.

In accordance with at least one embodiment, the traffic control assembly further include a flexible outer tube including a plurality of apertures, wherein the flexible tubular member includes a plurality of retention elements, the retention elements being configured to engage the plurality of apertures to secure the flexible outer tube to the flexible tubular member.

In accordance with at least one embodiment, the flexible outer tube includes a reflective component.

In accordance with at least one embodiment, the flexible outer tube includes a fringe extending from one end of the flexible outer tube toward a top surface of a middle portion of the flexible tubular member.

In accordance with at least one embodiment, the fringe is configured in a manner such that the flexible outer tube is secured firmly in place between one or more of the plurality of retention elements and the top surface of the middle portion of the flexible tubular member.

BRIEF DESCRIPTION OF DRAWINGS

So that the manner in which the features and advantages of the invention, as well as others which will become apparent, may be understood in more detail, a more particular description of the invention briefly summarized above may be had by reference to the embodiments thereof that are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Although the following detailed description contains many specific details for purposes of illustration, it is understood that one of ordinary skill in the relevant art will appreciate that many examples, variations, and alterations to the following details are within the scope and spirit of the invention. Accordingly, the exemplary embodiment of the invention described herein are set forth without any loss of generality, and without imposing limitations, relating to the claimed invention. Like numbers refer to like elements throughout.

Figure 1:
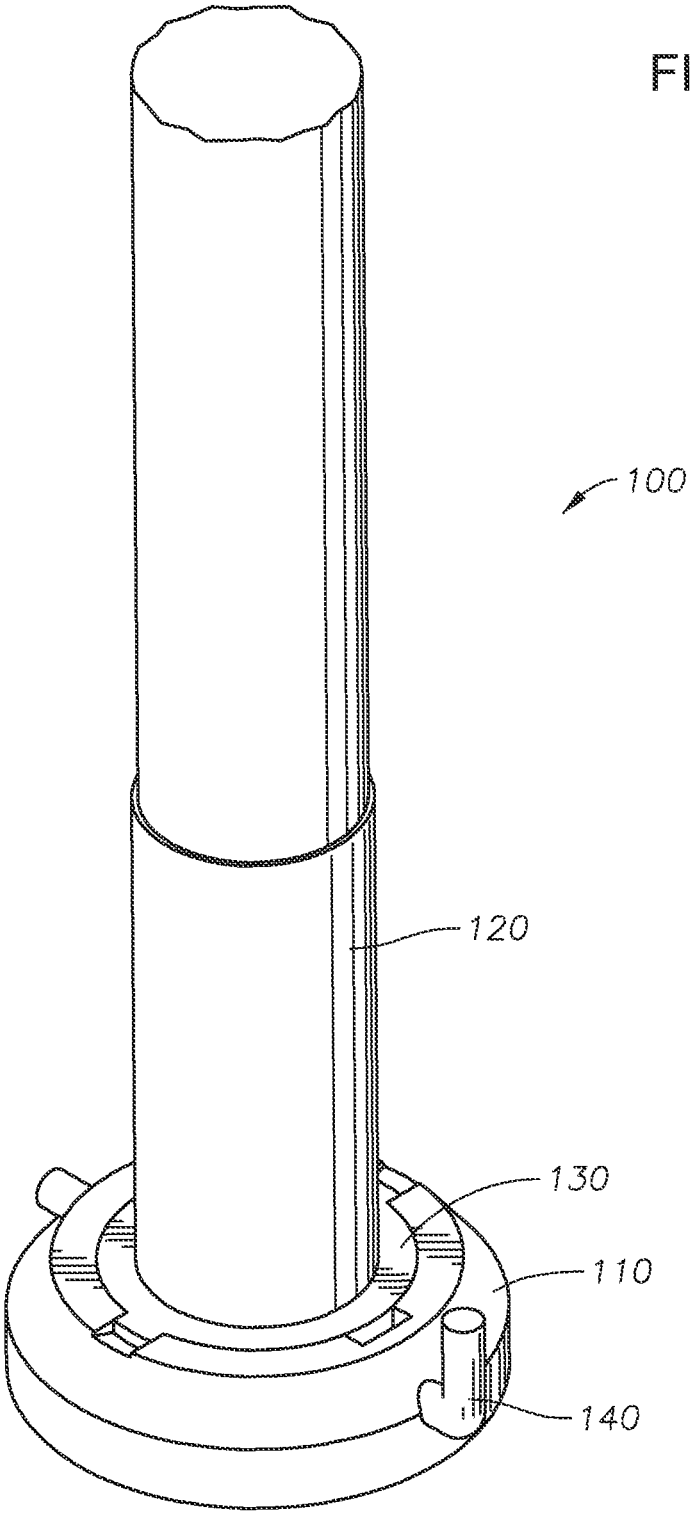
FIG. 1 is an isometric view of a traffic control assembly, in accordance with an embodiment of the invention.

Referring to FIGS. 1-11, embodiments of a traffic control assembly are shown. A traffic control device, traffic control assembly, roadside marker, or flexible delineator 100 (hereinafter collectively referred to as "traffic control assembly 100") for marking roadways or other marking areas is shown. FIG. 1 is an isometric view of a traffic control assembly, in accordance with an embodiment of the invention. As shown in FIG. 1, the traffic control assembly 100, in accordance with at least one embodiment, includes a base 110 and a flexible marker or primary tube 120 (hereinafter referred to as "flexible member 120") that extends substantially vertically from the base 110, when the flexible member 120 is in a non-impacted and non-deformed state (i.e., not impacted or deformed by a moving vehicle). In accordance with at least one embodiment, the flexible member 120 is sufficiently thick to resist casual bending or flexing along its length from forces, for example, a strong wind. As such, the flexible member 120 remains substantially vertically upright, when the flexible member 120 is in a non-impacted and non-deformed state (i.e., not impacted or deformed by a moving vehicle). The flexible member 120 is sufficiently flexible, so that it will elastically deform along its length, when a physical object forcibly applies a significant impact thereto, for example, by a moving vehicle or automobile.

As further shown in FIG. 1, the traffic control assembly 110 includes a reinforced retaining member 130 and a retaining pin 140.

In accordance with at least one embodiment, as shown in FIG. 1, the base 110 includes a cylindrical and conical shape, while in at least one other embodiment, the base is configured in the shape of a square or rectangle (not shown), or alternatively any other suitable shape. These various shapes may be suitable for uneven terrain to better stabilize the traffic control assembly 100, when the surface of the supporting ground is not level. For example, on a roadway having a sloped shoulder, the base 110 having an elongated shape (e.g., oval with a size of, for example, 4 inches by 18 inches), with a long side of the base 110 being parallel to the roadway, may be used to better follow the contour of the shoulder in which the traffic control assembly 100 is located. The base 110 having a round shape, as shown in FIG. 1, will be discussed in more detail below.

As further shown in FIG. 1, when the traffic control assembly 100 is assembled, the reinforced retaining member 130 is positioned in a recess in the base 110 to secure a base of the flexible member 120 to the base 110. According to at least one embodiment, the retaining pin 140 is inserted through apertures in the base 110, the flexible member 120, and the reinforced retaining member 140 to secure these elements of the traffic control assembly 100 to one another.

According to at least one embodiment, as shown in FIG. 1, the retaining pin 140 is formed with a length that allows it to extend in one side of the base 110, through the reinforced retaining member 130, through the flexible member 120, and out the other side of the base 110. The retaining pin 140 further includes a handle to permit a user to insert and remove the retaining pin 140 with ease.

Figure 2:
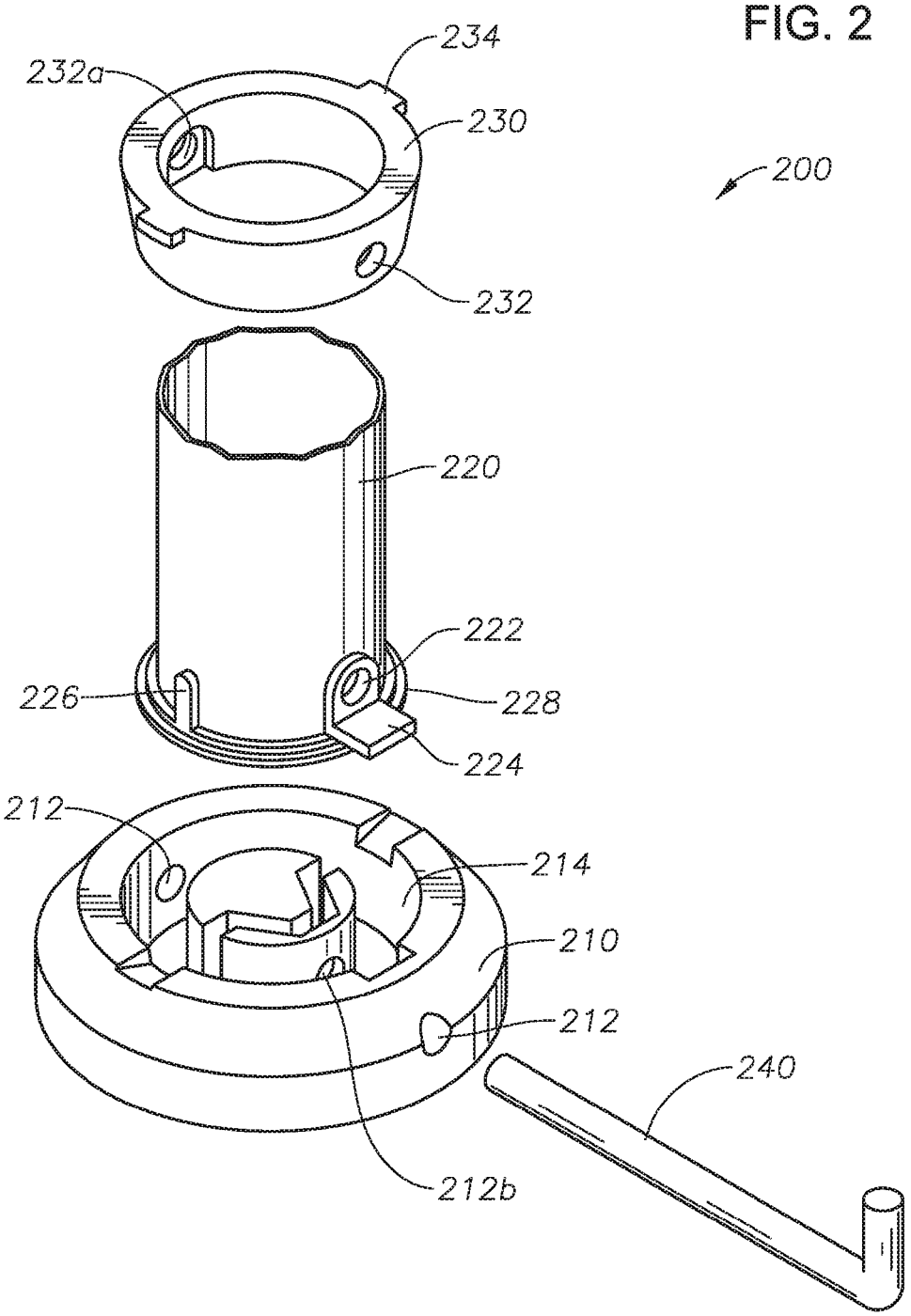
FIG. 2 is an exploded isometric view of the traffic control assembly shown in FIG. 1, in accordance with an embodiment of the invention.

FIG. 2 is an exploded isometric view of the traffic control assembly shown in FIG. 1, in accordance with an embodiment of the invention. As shown in FIG. 2, the traffic control assembly 200, in accordance with at least one embodiment, includes a base 210, a flexible member 220, a reinforced retaining member 230, and a retaining pin 240. As briefly discussed with respect to FIG. 1, each of the base 210, the flexible member 220, and the reinforced retaining member 230 includes a plurality of apertures configured to receive the retaining pin 240 therethrough. For example, the base 210 includes a plurality of apertures 212, the flexible member 220 includes a plurality of apertures 222, and the reinforced retaining member 230 includes a plurality of apertures 232.

In accordance with at least one embodiment, the base 210 includes four apertures 212, where two apertures 212*a* are positioned in opposing sides of an outer portion of the base 210 and two apertures 212*b* are positioned in opposing sides of an inner portion of the base 210, such that all four apertures 212 are aligned with one another to receive the retaining pin 240. Similarly, the flexible member 220 includes two apertures 222 positioned in opposing sides of the flexible member 220, where the two apertures 222 are in alignment with one another to receive the retaining pin 240 therethrough. In accordance with at least one embodiment, as will be discussed in more detail below, one aperture 222 in the flexible member 220 has a circular shape, and the other aperture 222 in the flexible member 220 has an elongated, in the vertical direction, shape.

According to at least one embodiment, at least one of the apertures 222 in the flexible member 220 has at least one first tab 224, extending outwards from the side of the flexible member 220. As shown, for example, in FIG. 2, the at least one first tab 224 includes a horizontal seating portion extending perpendicular from the side of the flexible member 220 and a vertical portion attaching the horizontal seating portion to the side of the flexible member 220. According to at least one embodiment, each of the horizontal and vertical portions of the at least one first tab 224 reinforces and supports the retaining pin 240, when the retaining pin 240 is inserted through the apertures 222 of the flexible member 220. According to at least one embodiment, the horizontal seating portion is arranged to align with a groove formed in the base 210 for aligning the apertures 212 and 222, when the retaining pin 240 is inserted through the base 210 and the flexible member 220.

According to at least one embodiment, the flexible member further includes at least one second tab 226 oriented, for example, 90° on either side of the at least one first tab 224 of the flexible member 220. The at least one second tab 226 is arranged to align with a respective protrusion 234 extending from the surface of the reinforced retaining member 230 to serve as alignment elements and further reinforce the connection between the elements of the traffic control assembly 200.

As further shown in FIG. 2, the reinforced retaining member 230, according to at least one embodiment, includes two apertures 232 in opposing sides of the reinforced retaining member 230. According to at least one embodiment, an inside surface of the reinforced retaining member 230 includes at least one first cut-out portion 232*a* having the same shape as the at least one first tab 224 of the flexible member 220, such that, when the reinforced retaining member 230 is placed over and around the flexible member 220 and slid down around the flexible member 220 to engage a lower flange 228 of the flexible member 220, for example, in the recess 214 of the base 210, the apertures 222 and 232 are in alignment with one another, so that the retaining pin 240 can be inserted therethrough. Hence, the at least one first tab 224 and the at least one first cut-out portion 232*a* serve as alignment elements and further reinforce the connection between these elements of the traffic control assembly 200.

According to at least one embodiment, the reinforced retaining member 230 further includes a plurality of protrusions 234 arranged to extend from a surface, for example, a top surface, of the reinforced retaining member 230, which align the reinforced retaining member 230 in the base 210, when the reinforced retaining member 230 engages the lower flange 228 of the flexible member 220 and is positioned in the recess 214 of the base 210, such that the apertures 212, 222, and 232 are in alignment with one another. As shown in FIG. 2, the plurality of protrusions 234 are arranged to correspond with grooves in the base 210, for example, offset 90° on either side of the groove in the base 210 for receiving the at least one first tab 224 of the flexible member 220. One of ordinary skill in the relevant art would have understood that the plurality of protrusions 234 could be arranged in other orientations around the reinforced retaining member 230 to correspond to the grooves in the base 210, as long as they serve the purposes of alignment and reinforcement.

Figure 3:
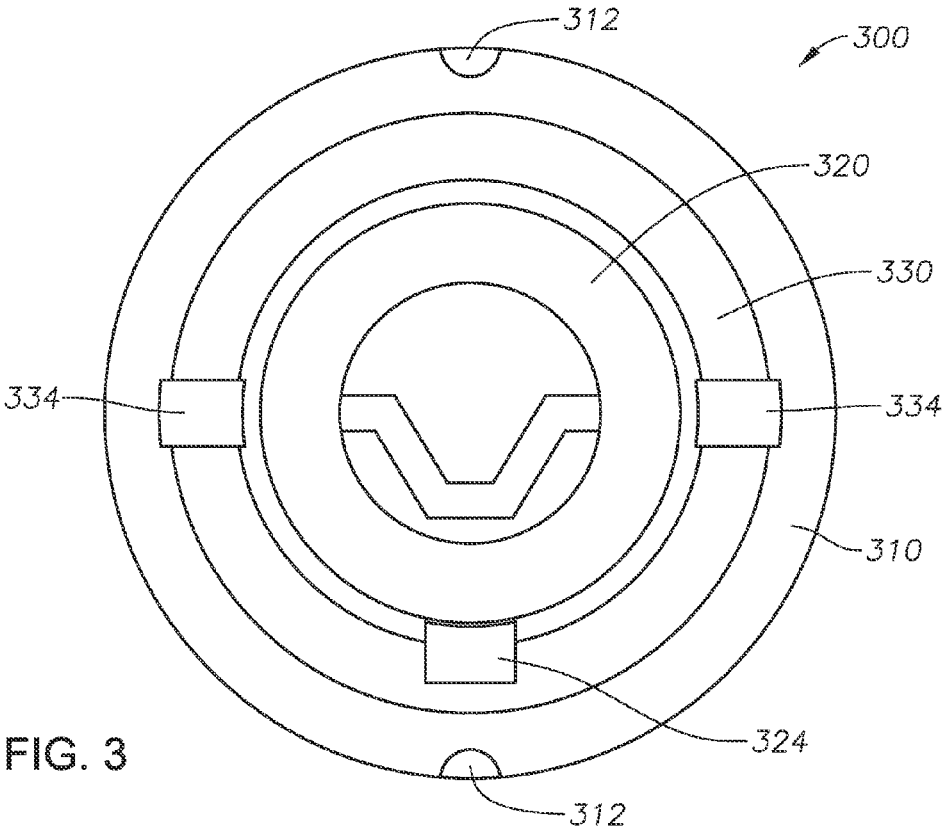
FIG. 3 is a top view of a base assembly of the traffic control assembly shown in FIGS. 1 and 2, in accordance with an embodiment of the invention.

FIG. 3 is a top view of a base assembly of the traffic control assembly shown in FIGS. 1 and 2, in accordance with an embodiment of the invention. The base assembly 300, according to at least one embodiment, includes the base 310, the flexible member 320, and the reinforced retaining member 330. As similarly described with respect to FIGS. 1 and 2 above, the base member includes apertures 312, the flexible member 320 includes at least one first tab 324, and the reinforced retaining member 330 includes a plurality of protrusions 334.

Figure 4:
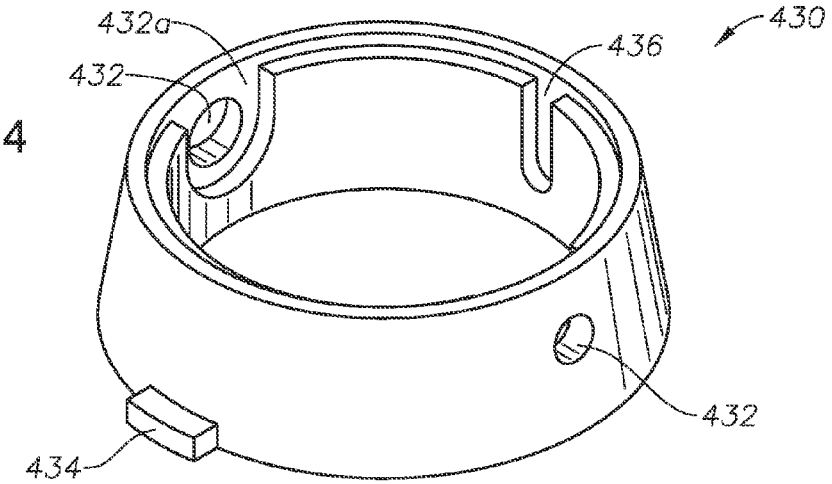
FIG. 4 is a perspective view of a reinforced retaining member of the traffic control assembly shown in FIGS. 1 and 2, in accordance with an embodiment of the invention.

FIG. 4 is a perspective view of a reinforced retaining member of the traffic control assembly shown in FIGS. 1 and 2, in accordance with an embodiment of the invention. The reinforced retaining member 430 in FIG. 4 is oriented upside-down to better illustrate the features of the reinforced retaining member 430. As similarly described with respect to FIGS. 1 and 2 above, the reinforced retaining member 430 includes apertures 432, the at least one first cut-out portion 432*a*, and the plurality of protrusions 434. As further shown in FIG. 4, the reinforced retaining member 430 further includes at least one second cut-out portion 436 oriented, for example, 90° on either side of the first cut-out portion 432*a*. The at least one second cut-out portion 436 is configured to have the same shape as the at least one second tab 226 of the flexible member 220 shown in FIG. 2.

Figure 5:
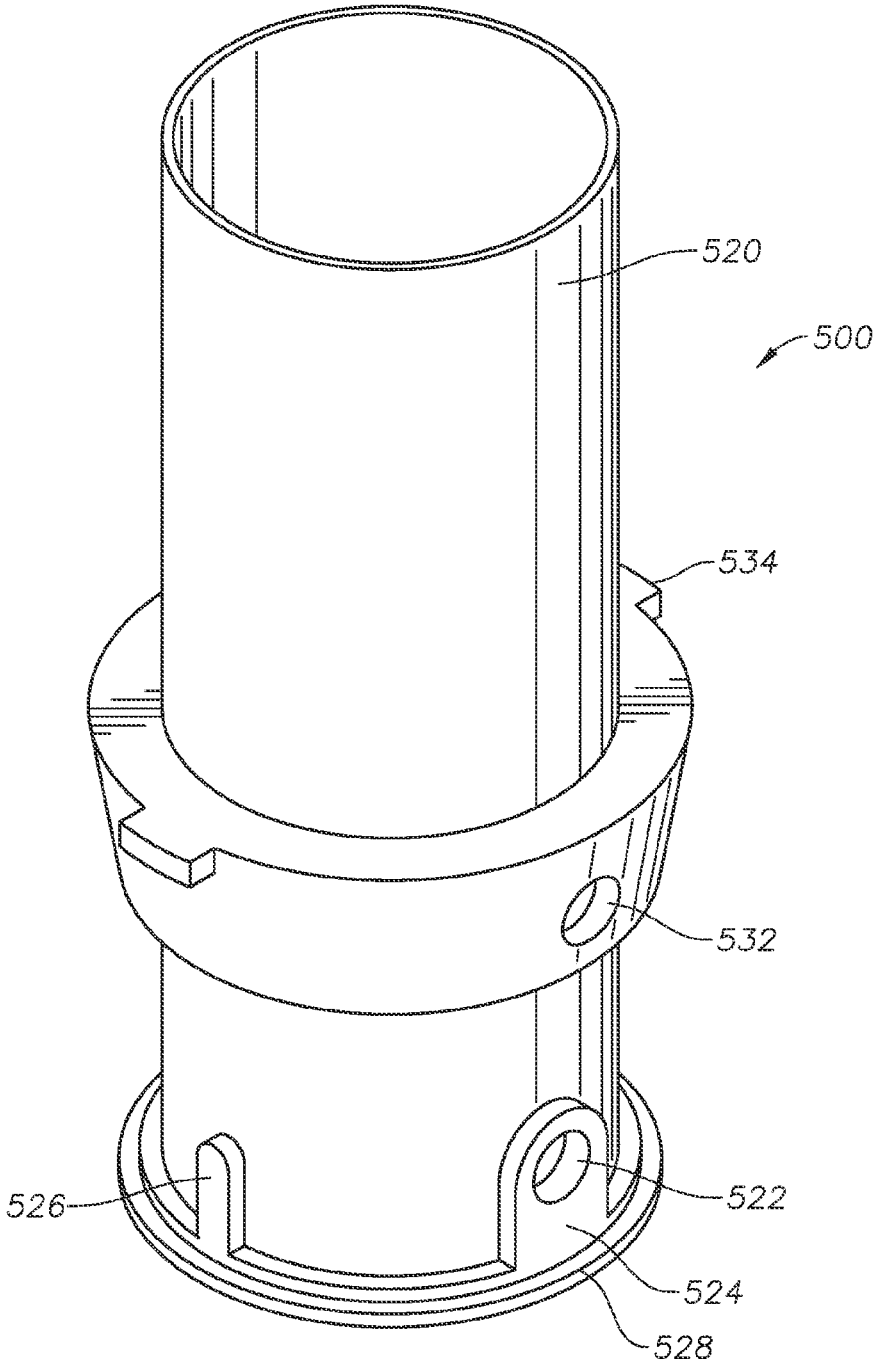
FIG. 5 is an enlarged perspective view of the reinforced retaining member shown in FIG. 4 and a flexible tubular member of the traffic control assembly shown in FIGS. 1 and 2, in accordance with an embodiment of the invention.

FIG. 5 is an enlarged perspective view of the reinforced retaining member shown in FIG. 4 and a flexible tubular member of the traffic control assembly shown in FIGS. 1 and 2, in accordance with an embodiment of the invention. FIG. 5 shows, in particular, the alignment of the aperture 532 of the reinforced retaining member 530 with the aperture 522 and the first tab 524 of the flexible member 520, and the alignment of one of the plurality of protrusions 534 of the reinforced retaining member 530 with the second tab 526 of the flexible member 520, as the reinforced retaining member 530 is slid over and onto the flexible member 520 to engage the lower flange 528 of the flexible member 520.

Figure 6B:
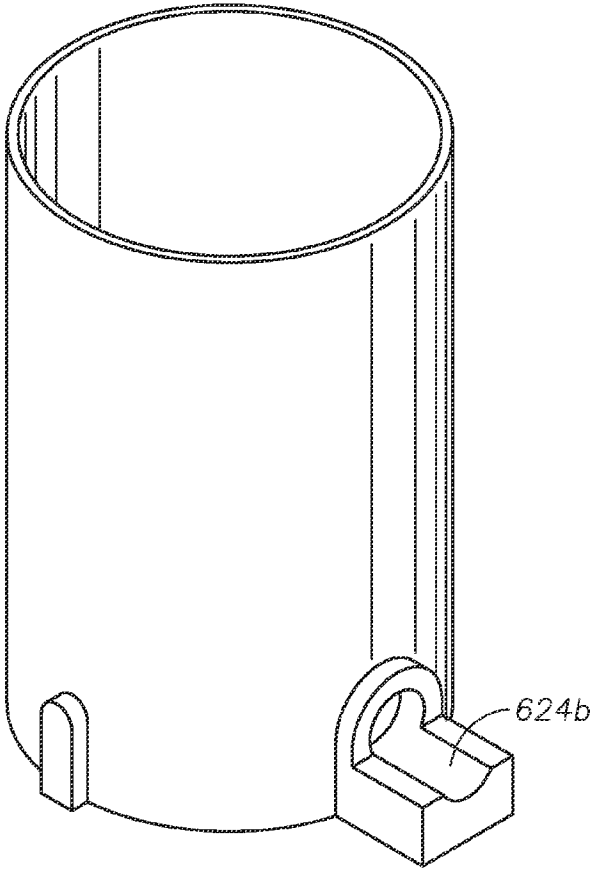
FIGS. 6A and 6B are perspective views of the traffic control assembly shown in FIGS. 1 and 2 further illustrating the at least one first tab, in accordance with an embodiment of the invention.
Figure 6A:
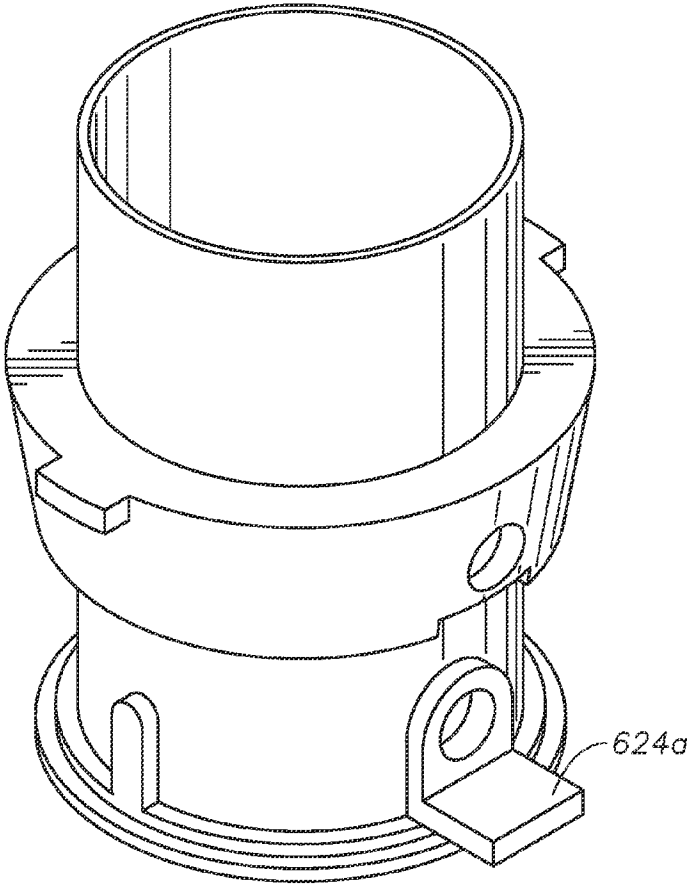

FIGS. 6A and 6B are perspective views of the traffic control assembly shown in FIGS. 1 and 2 further illustrating the at least one first tab, in accordance with an embodiment of the invention. As shown in FIGS. 6A and 6B, the at least one first tab 624 may include various shapes and sizes: 624*a* in FIG. 6A and 624*b* in FIG. 6B. One embodiment of the at least one first tab 624 includes a configuration previously described with respect to FIG. 2. According to another embodiment, the horizontal seat portion includes a curved groove to receive the retaining pin for further reinforcing the retaining pin during impact of the traffic control assembly by, for example, a moving vehicle. One of ordinary skill in the relevant art would have understood that other shapes and sizes of the at least one first tab 624 could be provided as long as they serve the purpose of reinforcing the retaining pin during impact of the traffic control assembly by, for example, a moving vehicle.

Figure 7:
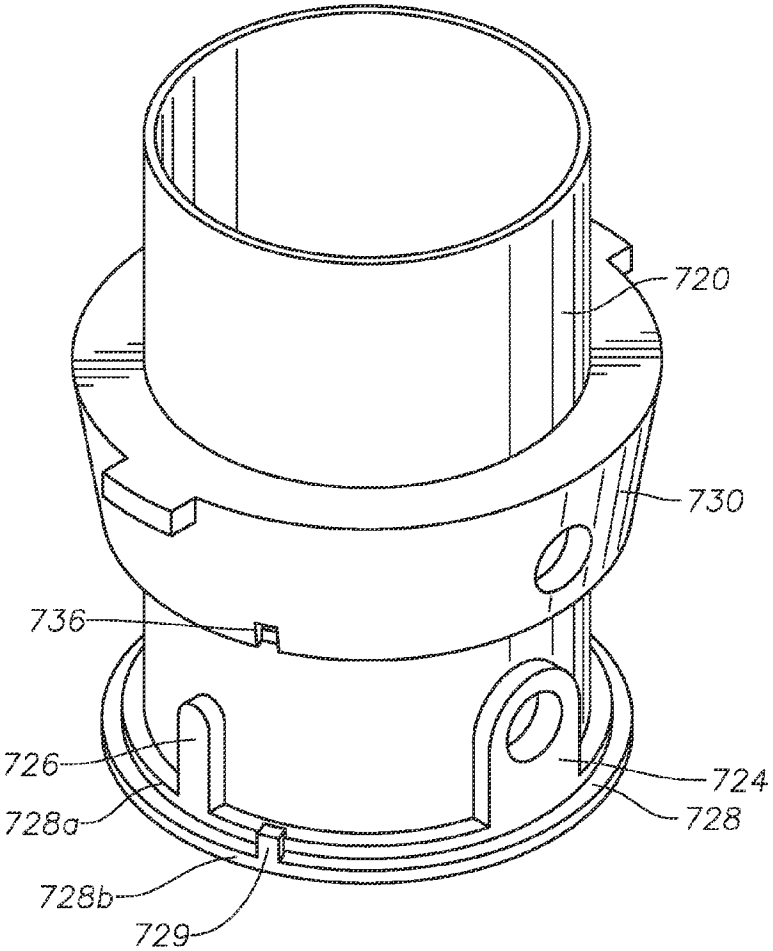
FIG. 7 is a perspective view of another reinforced retaining member of the traffic control assembly shown in FIGS. 1 and 2, in accordance with an embodiment of the invention.

FIG. 7 is a perspective view of another reinforced retaining member of the traffic control assembly shown in FIGS. 1 and 2, in accordance with an embodiment of the invention. As shown in FIG. 7, the lower flange 728 of the flexible member 720 further includes an upper step 728*a* and a lower step 728*b*. According to at least one embodiment, the at least one first tab 724 and the at least one second tab 726 extend vertically up the side of the flexible member 720 from the upper step 728*a*, and at least one third tab 729 extends vertically up from the lower step 728*b*, as shown, for example, in FIG. 7. As further shown in FIG. 7, the reinforced retaining member 730 further includes at least one notch 736 corresponding to the at least one third tab 729 of the flexible member 720.

Figure 8:
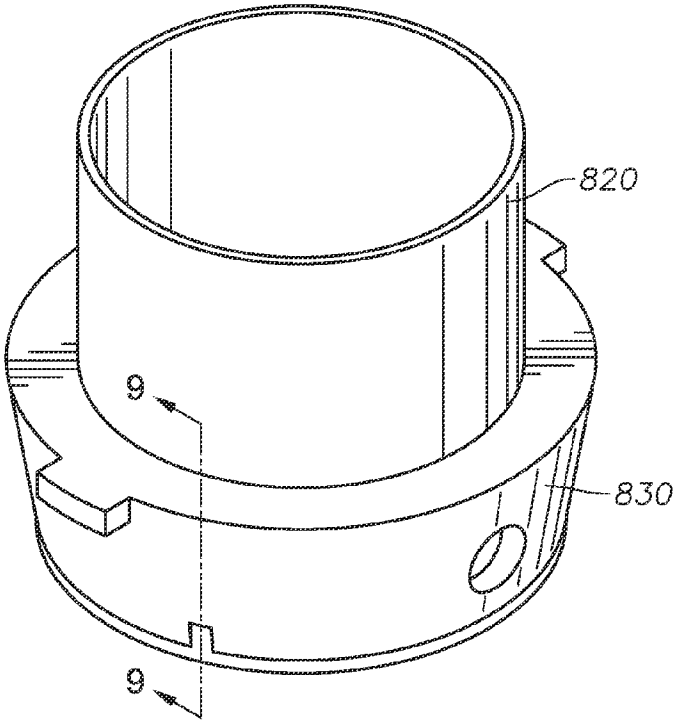
FIG. 8 is another perspective view of the reinforced retaining member shown in FIG. 7 of the traffic control assembly shown in FIGS. 1 and 2, in accordance with an embodiment of the invention.

FIG. 8 is another perspective view of the reinforced retaining member shown in FIG. 7 of the traffic control assembly shown in FIGS. 1 and 2, in accordance with an embodiment of the invention. FIG. 8 illustrates the assembly of the flexible member 820 and the reinforced retaining member 830, when the at least one third tab 729 and the at least one notch 736, as shown in FIG. 7, are in alignment and engage one another. As can be seen from FIG. 8, apertures of the flexible member 820 and the reinforced retaining member 830 are in alignment, such that the retaining pin described above can be inserted there through.

According to at least one embodiment, each of the first, second, and third tabs is made of plastic, although one of ordinary skill in the relevant art would have understood that each of these tabs could be made from other materials, which have a durability that would prevent each of these tabs from ripping, when the traffic control assembly is impacted by, for example, a moving vehicle.

Figure 9:
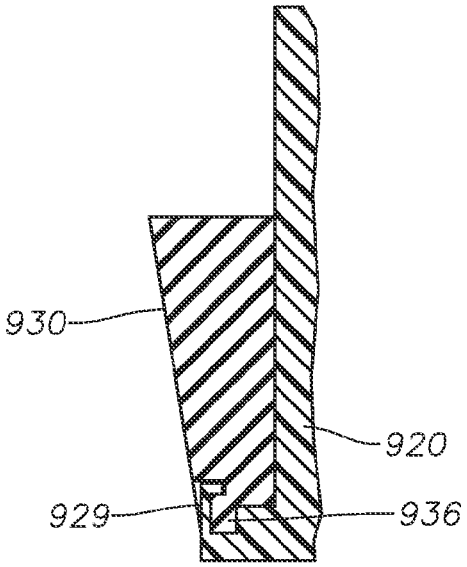
FIG. 9 is a cross-sectional view of reinforced retaining member, as shown in FIGS. 7 and 8, engaging the flexible tubular member of the traffic control assembly shown in FIGS. 1 and 2, in accordance with an embodiment of the invention.

FIG. 9 is a cross-sectional view of reinforced retaining member, as shown in FIGS. 7 and 8, engaging the flexible tubular member of the traffic control assembly shown in FIGS. 1 and 2, in accordance with an embodiment of the invention. In accordance with at least one embodiment, the at least one third tab 929 of the flexible member 920 includes a clip configuration, which engages the notch 936 of the reinforced retaining member 930 to detachably clip (i.e., detachably lock) the flexible member 920 in alignment with the reinforced retaining member 930.

Figure 10A:
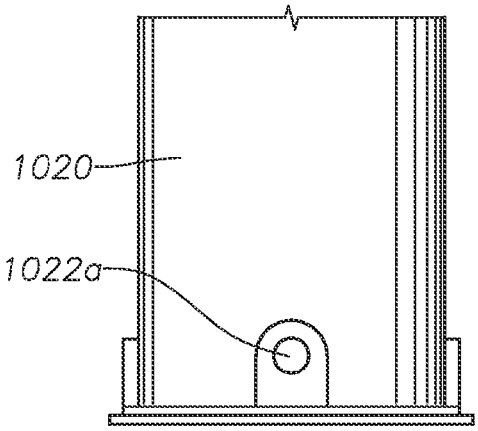
FIGS. 10A and 10B are side views of the flexible tubular member of the traffic control assembly shown in FIGS. 1 and 2, in accordance with an embodiment of the invention.
Figure 10B:
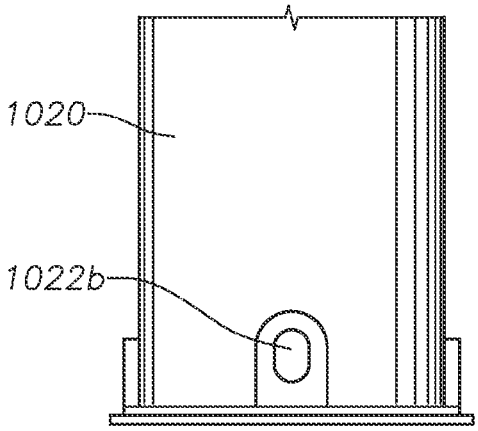

FIGS. 10A and 10B are side views of the flexible tubular member of the traffic control assembly shown in FIGS. 1 and 2, in accordance with an embodiment of the invention. As discussed above with respect to FIG. 2 of the present application, one aperture 1022*a*, as shown in FIG. 10A, in the flexible member 1020 has a circular shape, and the other aperture 1022*b*, as shown in FIG. 10B, in the flexible member 1020 has an elongated, in the vertical direction, shape. According to at least one embodiment, the retaining pin is inserted into the aperture 1022*a*, through the traffic control assembly, and out of the aperture 1022*b*. According to at least one embodiment, the traffic control assembly is arranged, such that the aperture 1022*a* faces the impact area of the moving vehicle, such that the retaining pin, when displaced upon impact by the moving vehicle, has a degree of freedom of movement in the rear portion of the traffic control assembly. The traffic control assembly, according to various embodiments of the invention, having this configuration has non-obvious advantages over conventional traffic control markers with respect to maintaining the resiliency of the flexible tubular member and anchoring the flexible tubular member to the traffic control assembly.

Figure 11:
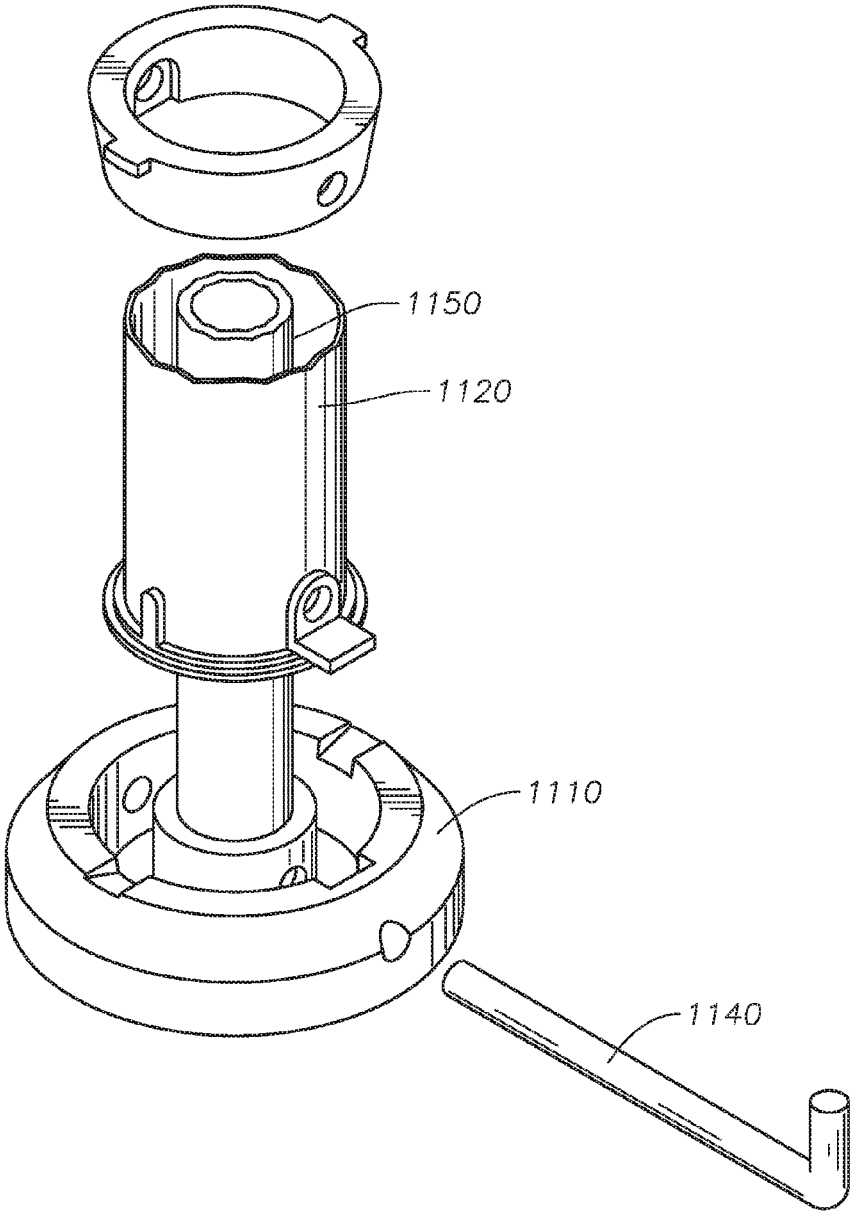
FIG. 11 is an exploded isometric view of the traffic control assembly, in accordance with an embodiment of the invention.

FIG. 11 is an exploded isometric view of the traffic control assembly, in accordance with an embodiment of the invention. To improve the elastic properties of the flexible member 120, as shown in FIG. 1, a flexible core 1150 can be arranged inside the flexible member 1120, as shown in FIG. 11. In accordance with at least one embodiment, the flexible core 1150 is formed from a resilient material, for example, rubber, as a non-limiting example. As further shown in FIG. 11, the flexible core 1150 is configured to be secured in the base 1110, and includes a plurality of apertures (not shown) to receive the retaining pin 1140 there through. In accordance with another embodiment, the flexible core 1150 is arranged inside the flexible member 1120, but is not secured in the base 1110, as previously described (i.e., the flexible core 1150 is removably placed inside the flexible member 1120).

Figure 12:
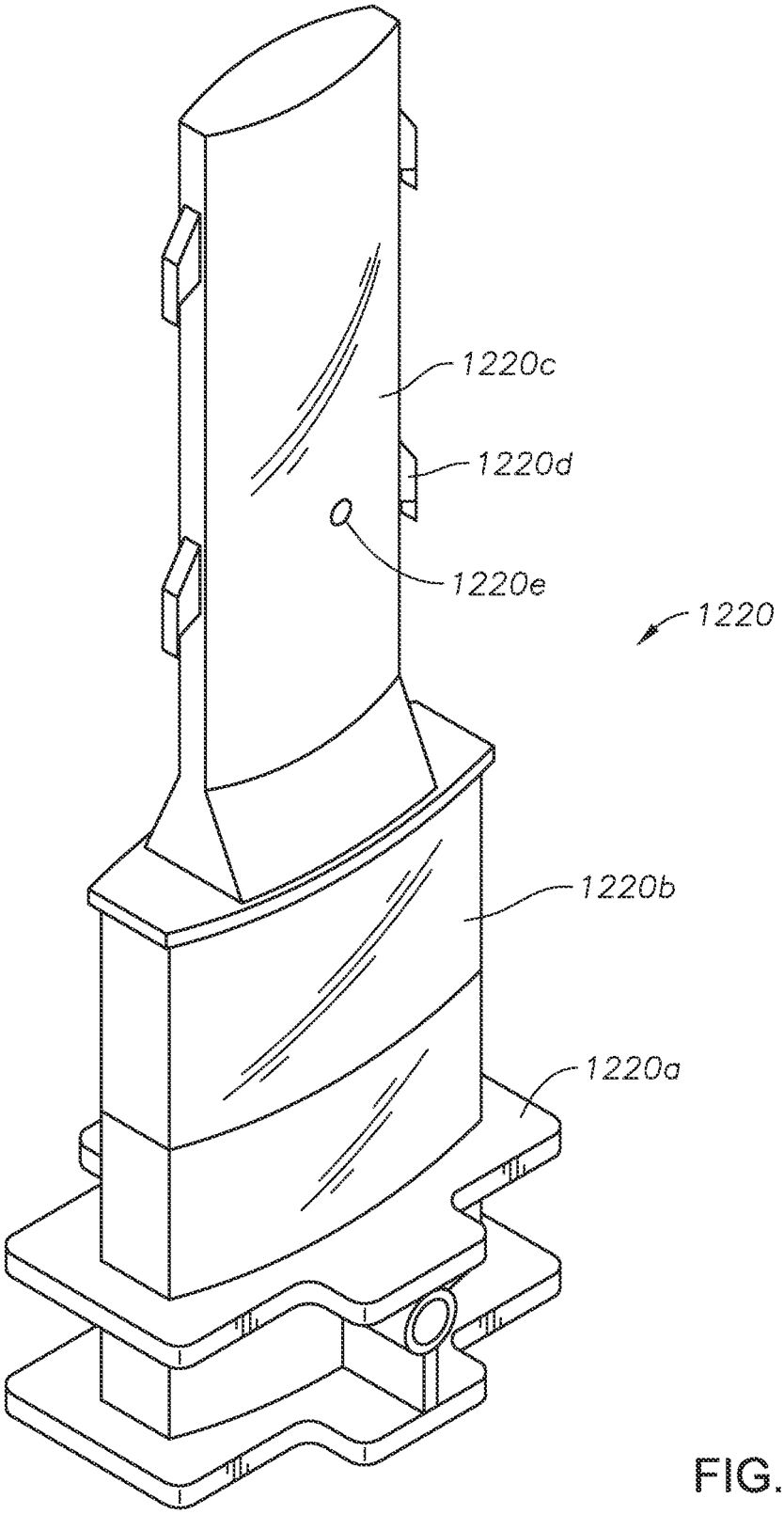
FIG. 12 an isometric view of another traffic control assembly, in accordance with an embodiment of the invention.
Figure 13:
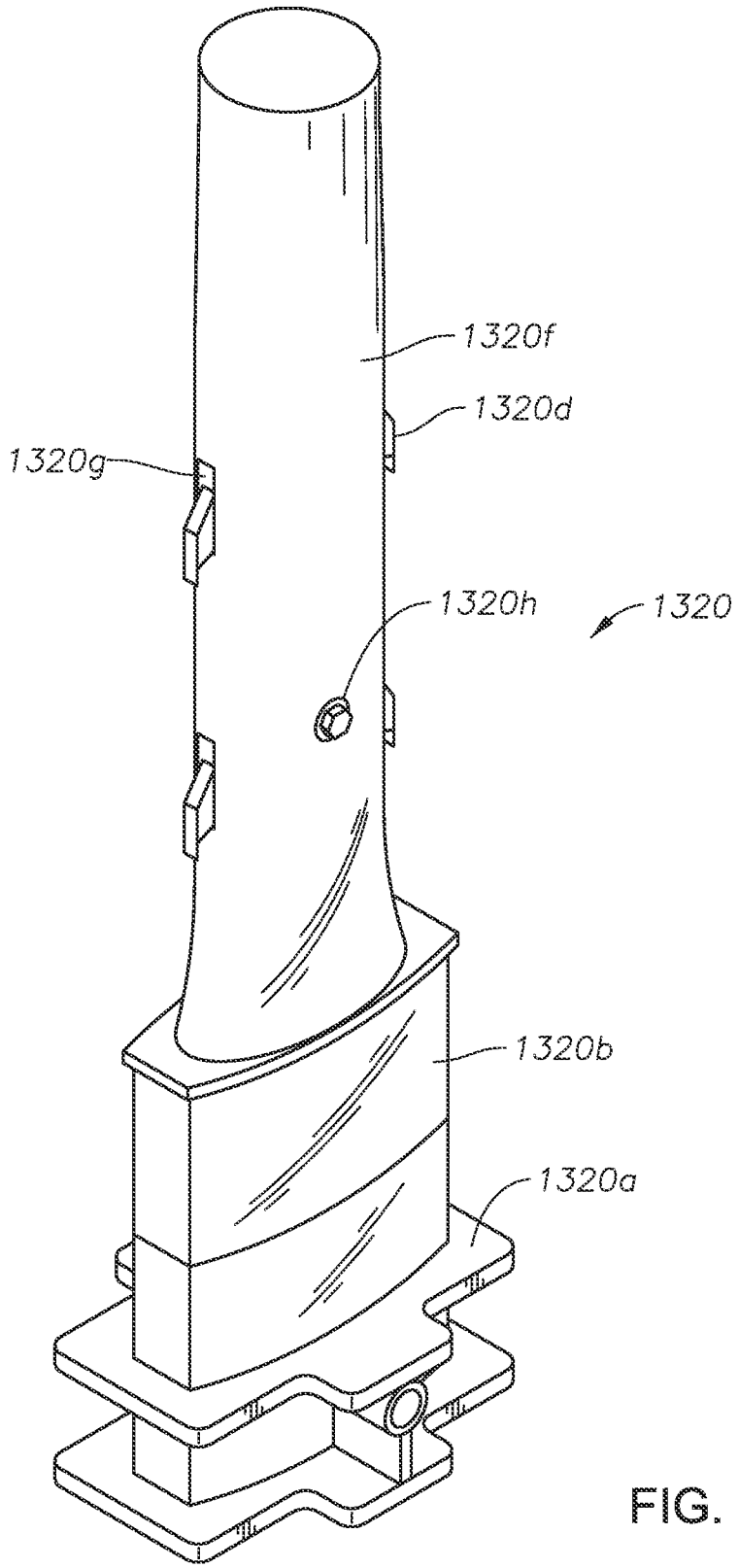
FIG. 13 is an isometric view of the traffic control assembly shown in FIG. 12, including a flexible outer tube or reflective component, in accordance with an embodiment of the invention.
Figure 14:
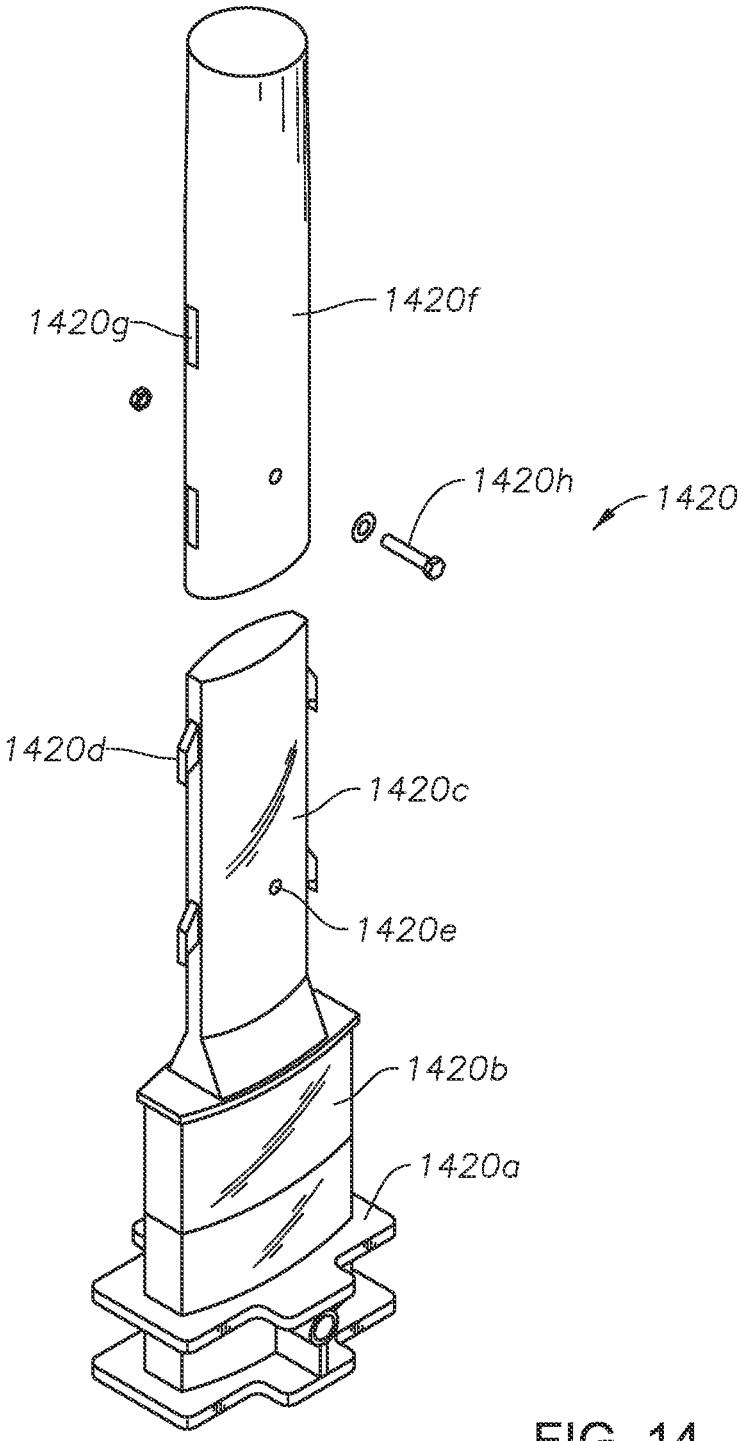
FIG. 14 is an exploded isometric view of the traffic control assembly shown in FIGS. 12 and 13, in accordance with an embodiment of the invention.

FIG. 12 an isometric view of another traffic control assembly, in accordance with an embodiment of the invention. As noted above with respect to FIG. 2, the base is configured in the shape of a square or rectangle (not shown), or alternatively any other suitable shape. FIG. 13 is an isometric view of the traffic control assembly shown in FIG. 12, including a flexible outer tube or reflective component, in accordance with an embodiment of the invention. FIG. 14 is an exploded isometric view of the traffic control assembly shown in FIGS. 12 and 13, in accordance with an embodiment of the invention.

As shown in FIGS. 12-14, the traffic control assembly, in accordance with at least one embodiment, includes a flexible member 1220/1320/1420, which includes a base portion 1220*a*/1320*a*/1420*a*, a middle portion 1220*b*/1320*b*/1420*b*, and a post portion 1220*c*/1320*c*/1420*c*. In accordance with at least one embodiment, the base portion 1220*a*/1320*a*/1420*a* of the flexible member 1220/1320/1420 is configured to be inserted into the base (not shown) of the traffic control assembly, as described above. The post portion 1220*c*/1320*c*/1420*c* includes a plurality of ears or fingers 1220*d*/1320*d*/1420*d*, for example four as shown in FIGS. 12-14, that are locking retention features for retaining a flexible outer tube or reflective component 1320*f*/1420*f*. The ears or fingers 1220*d*/1320*d*/1420*d* are resilient members that slip through the flexible outer tube or reflective component 1320*f*/1420*f* and lock into holes 1320*g*/1420*g* formed in the sides of the flexible outer tube or reflective component 1320*f*/1420*f*. As further shown in FIGS. 12 and 14, the flexible member 1220/1420 further includes an aperture 1220*e*/1420*e* for further securing the flexible outer tube or reflective component 1320*f*/1420*f* to the flexible member 1220/1420 using, for example, one of a screw, bolt, or a brad 1320*h*/1420*h* (hereinafter collectively referred to as a "screw" 1320*h*/1420*h*).

Figure 15A:
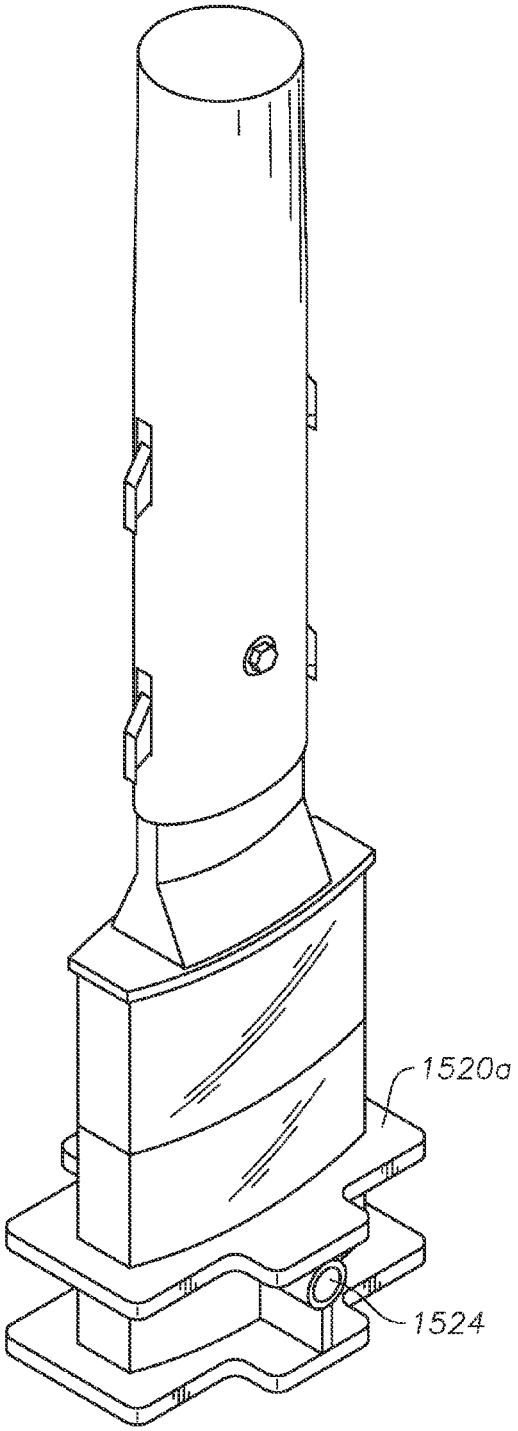
FIGS. 15A and 15B are isometric views of the traffic control assembly shown in FIGS. 12-14, in accordance with an embodiment of the invention.
Figure 15B:
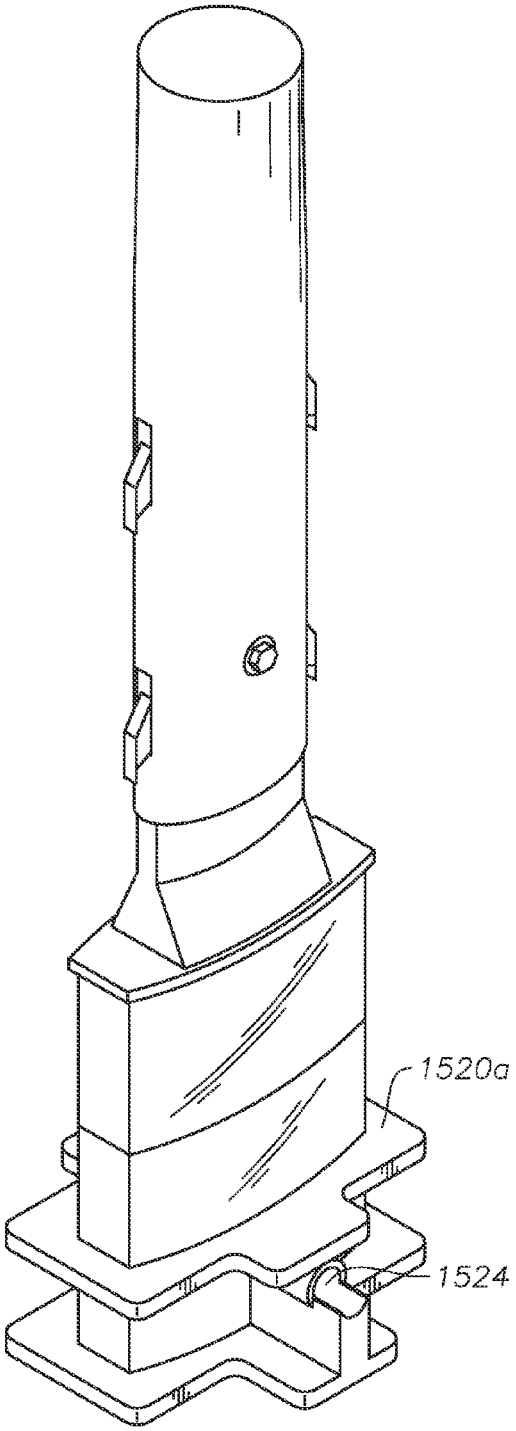

FIGS. 15A and 15B are isometric views of the traffic control assembly shown in FIGS. 12-14, in accordance with an embodiment of the invention. As discussed above with respect to FIGS. 6A and 6B, the at least one first tab 624 may include various shapes and sizes: 624*a* in FIG. 6A and 624*b* in FIG. 6B. Similarly, in FIGS. 15A and 15B, embodiments of the traffic control assembly include an aperture 1524 having an elongated shape extending horizontally from the side of the base portion 1520*a* of the flexible member 1520, as shown in FIG. 15A, and other embodiments of the traffic control assembly include the aperture 1524 including a horizontal seat portion having a curved groove to receive the retaining pin for further reinforcing the retaining pin during impact of the traffic control assembly by, for example, a moving vehicle, as shown in FIG. 15B. One of ordinary skill in the relevant art would have understood that other shapes and sizes of the aperture 1524 could be provided as long as they serve the purpose of reinforcing the retaining pin during impact of the traffic control assembly by, for example, a moving vehicle.

Figure 16:
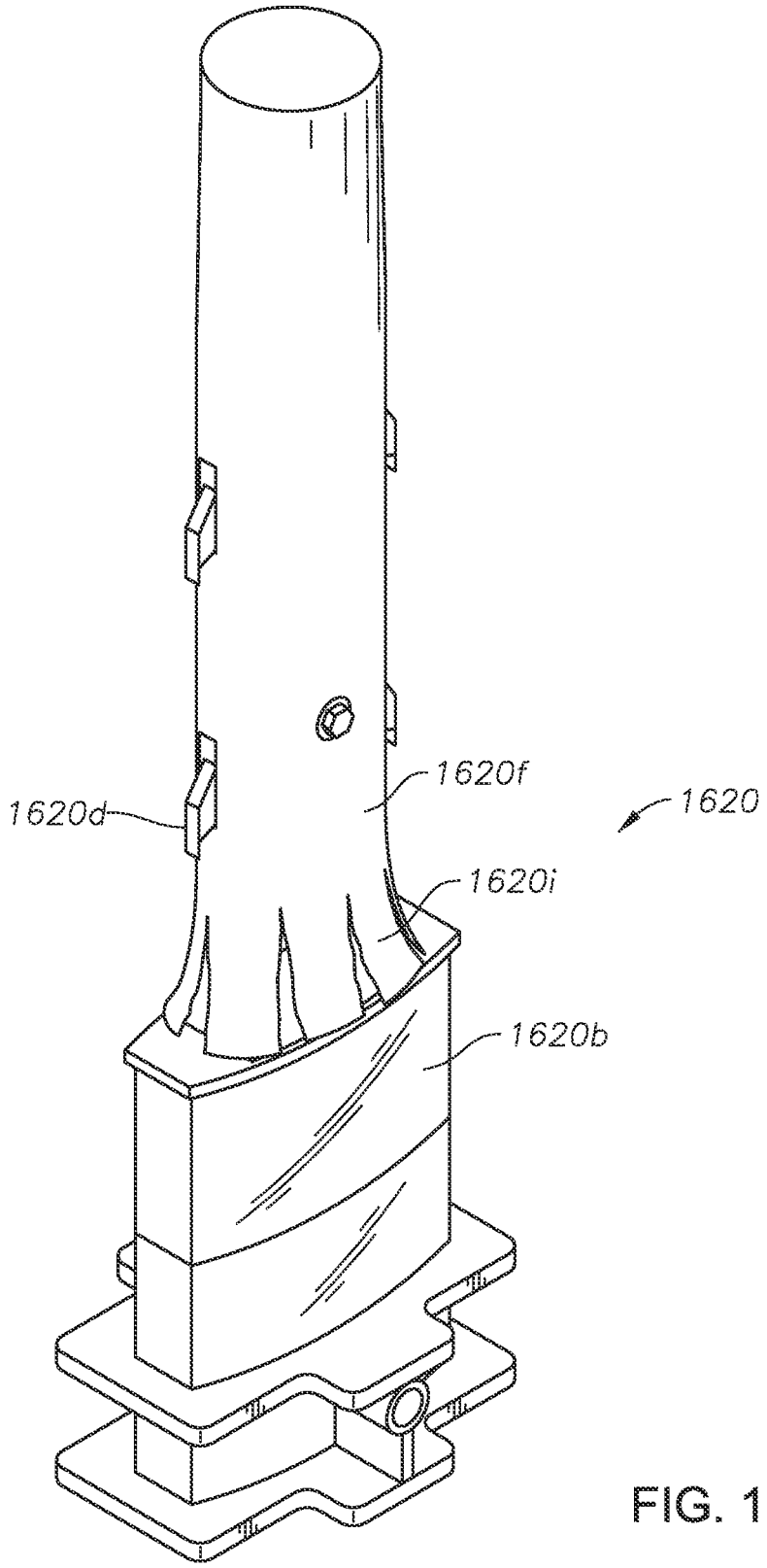
FIG. 16 is an isometric view of the traffic control assembly shown in FIG. 12, including another flexible outer tube or reflective component, in accordance with an embodiment of the invention.

FIG. 16 is an isometric view of the traffic control assembly shown in FIG. 12, including another flexible outer tube or reflective component, in accordance with an embodiment of the invention. The traffic control assembly, as shown in FIG. 16, includes similar elements as those described above for the traffic control assembly shown in FIG. 12, and therefore the above description for the traffic control assembly shown in FIG. 12 will not be repeated for describing the traffic control assembly shown in FIG. 16.

The traffic control assembly shown in FIG. 16 includes, however, a flexible outer tube or reflective component 1620*f*, which includes a fringe or a fray 1620*i* (hereinafter referred to as a/the "fringe") extending from one end of the flexible outer tube or reflective component 1620*f* toward a top surface of the middle portion 1620*b* of the flexible member 1620. The fringe 1620*i* of the flexible outer tube or reflective component 1620*f* is configured in a manner such that the flexible outer tube or reflective component 1620*f* is secured firmly between a bottom set of the plurality of ears or fingers 1620*d* and the top surface of the middle portion 1620*b* of the flexible member 1620. In accordance with at least one embodiment, the fringe 1620*i* is configured to force/hold the flexible outer tube or reflective component 1620*f* up against the bottom set of the plurality of ears or fingers 1620*d*, such that the fringe 1620*i* eliminates hammering of the flexible outer tube or reflective component 1620*f* upon impact of the traffic control assembly by, for example, a moving vehicle.

The present invention may suitably comprise, consist or consist essentially of the elements disclosed and may be practiced in the absence of an element not disclosed. For example, it can be recognized by those skilled in the art that certain structural elements can be combined into a single structural element.

Unless defined otherwise, all technical and scientific terms used have the same meaning as commonly understood by one of ordinary skill in the art to which this invention belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the embodiments of the present invention.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

I claim:

1. A traffic control assembly, comprising:

a base selectively mountable adjacent a roadway;

a flexible tubular marker coupled to the base;

a reinforced retaining member; and a retaining pin, wherein the reinforced retaining member, when positioned in a recess in the base, is configured to secure the flexible tubular marker to the base, and wherein the flexible tubular marker comprises a first aperture having a circular shape on a front side of the flexible tubular marker and a second aperture having an elongated shape in the vertical direction on a back side of the flexible tubular marker, and wherein the retaining pin is inserted into the first aperture, through the base, the flexible tubular marker, and the reinforced retaining member, and out of the second aperture.

2. The traffic control assembly of claim 1, wherein the flexible tubular marker comprises at least one tab configured to reinforce and support the retaining pin.

3. The traffic control assembly of claim 2, wherein the at least one tab comprises a horizontal seating portion extending perpendicular from a side of the flexible tubular marker and a vertical portion configured to attach the horizontal seating portion to the side of the flexible tubular marker.

4. The traffic control assembly of claim 1, wherein the flexible tubular marker comprises at least one tab, the reinforced retaining member comprises at least one protrusion and at least one cut-out portion, and the base comprises at least one groove, wherein the at least one tab of the flexible tubular marker is configured to engage the at least one cut-out portion of the reinforced retaining member and the at least one protrusion of the reinforced retaining member is configured to engage the at least one groove in the base, when the reinforced retaining member is slid down around the flexible tubular marker to engage a lower flange of the flexible tubular marker in the recess of the base and the retaining pin is inserted through apertures in the base, the flexible tubular marker, and the reinforced retaining member.

5. The traffic control assembly of claim 2, wherein the at least one tab comprises a curved groove configured to receive the retaining pin for reinforcing the retaining pin during impact of the traffic control assembly by a moving object.

6. The traffic control assembly of claim 1, wherein the flexible tubular marker comprises a lower flange, the lower flange comprising an upper step and a lower step.

7. The traffic control assembly of claim 6, wherein the lower step of the lower flange comprises at least one tab configured to engage a groove in the base of reinforced retaining member for detachably clipping the flexible tubular marker in alignment with the reinforced retaining member.

8. The traffic control assembly of claim 1, further comprising:

a flexible core arranged inside the flexible tubular marker and configured to be secured in the base.

9. The traffic control assembly of claim 8, wherein the flexible core further comprises at least one aperture configured to receive the retaining pin there through.

10. The traffic control assembly of claim 1, further comprising:

a flexible outer tube comprising a plurality of apertures, wherein the flexible tubular marker comprises a plurality of retention elements, the retention elements being configured to engage the plurality of apertures to secure the flexible outer tube to the flexible tubular marker.

11. The traffic control assembly of claim 10, wherein the flexible outer tube comprises a reflective component.

12. The traffic control assembly of claim 10, wherein the flexible outer tube comprises a fringe extending from one end of the flexible outer tube toward a top surface of a middle portion of the flexible tubular marker.

13. The traffic control assembly of claim 12, wherein the fringe is configured in a manner such that the flexible outer tube is secured firmly in place between one or more of the plurality of retention elements and the top surface of the middle portion of the flexible tubular marker.

* * * * *